US008770435B2

(12) United States Patent
Weiss

(10) Patent No.: US 8,770,435 B2
(45) Date of Patent: Jul. 8, 2014

(54) CLOSURE INDICATOR FOR LID

(71) Applicant: David I. Weiss, Boca Raton, FL (US)

(72) Inventor: David I. Weiss, Boca Raton, FL (US)

(73) Assignee: uVu Technologies, LLC, Boca Raton, FL (US)

( * ) Notice: Subject to any disclaimer, the term of this patent is extended or adjusted under 35 U.S.C. 154(b) by 0 days.

(21) Appl. No.: 13/899,033

(22) Filed: May 21, 2013

(65) Prior Publication Data

US 2013/0306666 A1 Nov. 21, 2013

Related U.S. Application Data

(60) Provisional application No. 61/649,855, filed on May 21, 2012.

(51) Int. Cl.
*B65D 41/18* (2006.01)
*B65D 41/16* (2006.01)

(52) U.S. Cl.
USPC ..... 220/784; 220/780; 220/794

(58) Field of Classification Search
CPC ..... B65D 43/10; B65D 41/06; B65D 41/16; B65D 85/00; B65D 51/18; B65D 41/18
USPC ..... 220/784, 780, 786, 794
See application file for complete search history.

(56) References Cited

U.S. PATENT DOCUMENTS

| | | | | |
|---|---|---|---|---|
| 8,307,982 | B1 * | 11/2012 | Vovan | 206/467 |
| 8,479,948 | B2 * | 7/2013 | Weiss et al. | 220/794 |
| 2008/0073347 | A1 * | 3/2008 | Shadrach | 220/254.9 |

* cited by examiner

*Primary Examiner* — Anthony Stashick
*Assistant Examiner* — Jennifer N Zettl
(74) *Attorney, Agent, or Firm* — Fox Rothschild LLP

(57) ABSTRACT

A lid for a container includes: a closure having a disk shape and a circumferential rim extending about a periphery of the closure; the circumferential rim further comprising an annular inner side wall, an annular outer side wall, wherein the outer side wall extends around the inner side wall and is opposite to the inner side wall, the outer side wall and inner side wall being interconnected by an annular top wall, the annular top wall interconnecting the outer side wall to the inner side wall, wherein the combination of the annular inner side wall, the annular outer side wall and the annular top wall define a channel; and a brim lock in the annular outer side wall for fastening the lid to the container; a plurality of dimples inverted along the annular outer side wall, wherein the plurality of dimples of the annular outer side wall project into the channel from the outer surface of the annular outer side wall and configured to be non-inverted dimples when the lid is secured onto the container.

19 Claims, 8 Drawing Sheets

CLOSURE INDICATOR FOR LID

This invention claims the benefit of U.S. Provisional Patent Application No. 61/649,855 filed on May 21, 2012, which is hereby incorporated by reference in its entirety.

BACKGROUND OF THE INVENTION

1. Field of the Invention

Embodiments of the invention relate to a lid for a container. More particularly, embodiments of the present invention are directed to a closure indicator for a lid that can be secured onto a container. Although embodiments of the invention are suitable for a wide scope of applications, it is particularly suitable for when the circumferential rim of a lid mates with the brim or rim of a container such that the dimples can then project outward to indicate the lid is appropriately secured onto the rim of the container.

2. Description of the Related Art

In general, lids known in the art include an annular outer rim that fastens over the brim of a container. However, the prior art lids are often deficient in that it is not readily known if the lid is secured appropriately onto the container. For example, if the lid is applied in haste onto a beverage container having liquid contents, the user may not have snapped the annular outer rim over the brim so as to fasten the lid onto the beverage container. In another example, the user may have bent the container while holding the container to create a slight gap or tolerance defined between the periphery of the annular circumferential rim and the brim of the container such that the lid can only be snapped onto the brim on two opposite sides of the beverage container. Once a user picks up a beverage container and attempts to drink from the container with the unsecured lid, the lid may become separated from the container and spillage of the contents may occur. Also, it is often difficult to quickly and accurately assess whether the lid is properly secured onto the container. In addition, the gap or tolerance between the circumferential rim of the lid and brim of the container will likely cause the lid to become completely dislodged from the container in the event a user accidentally spills the container, resulting in spillage of the contents therein.

Lids known in the prior art may not achieve a satisfactory sealing even with somewhat of a substantial fastening of the lid with the brim of a beverage container. Any gap or tolerance between the circumferential rim of the lid and brim of the container will likely result in a leak during use or cause the lid to become completely dislodged from the container in the event a user accidentally knocks over the container. Therefore, it is desirable to have a capability of being able to confirm proper lid closure and fastening of the lid onto a container so as to achieve a seal and prevent spillage.

SUMMARY OF THE INVENTION

Accordingly, embodiments of the invention are directed to a closure indicator for a lid that substantially obviates one or more of the problems due to limitations and disadvantages of the related prior art.

An object of embodiments of the invention is to provide a plurality of inverted dimples positioned along an outer side wall of a lid for a container.

Another object of embodiments of the invention is to provide at plurality of parallel ribs along an inner side wall of a circumferential rim of a lid for providing a seal fit to an inside surface of the container when the lid is secured to a brim of a container.

Another object of embodiments of the invention is to provide a lid with a plurality of support bases positioned along the outer side wall of the lid, wherein a dimple is mounted within each of the support bases.

Another object of embodiments of the invention is to provide dimples along an outer side wall of a lid such that the dimples reverse direction and project outwards beyond the outer side wall of the lid when the lid is appropriately secured to the brim of a container.

Another object of embodiments of the invention is to provide dimples along an outer side wall of a lid such that tracing the outer side wall with one or more fingers allows a user to touch the upper crown of the outwardly projecting dimples for both visual and tactile confirmation that the lid is appropriately attached to the brim of the container.

Another object of embodiments of the invention is to provide dimples along an outer side wall of a lid such that a raised dimple may revert to its original inverted position, by removing the lid from the container.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the lid for a container includes: a closure having a disk shape and a circumferential rim extending about a periphery of the closure; the circumferential rim further comprising an annular inner side wall, an annular outer side wall, wherein the outer side wall extends around the inner side wall and is opposite to the inner side wall, the outer side wall and inner side wall being interconnected by an annular top wall, the annular top wall interconnecting the outer side wall to the inner side wall, wherein the combination of the annular inner side wall, the annular outer side wall and the annular top wall define a channel; and a brim lock in the annular outer side wall for fastening the lid to the container; a plurality of dimples inverted along the annular outer side wall, wherein the plurality of dimples of the annular outer side wall project into the channel from the outer surface of the annular outer side wall and configured to be non-inverted dimples when the lid is secured onto the container.

In another aspect, a lid for a container includes: a closure having a disk shape and a circumferential rim extending about a periphery of the closure; the circumferential rim further comprising a raised annular inner side wall, a raised annular outer side wall, wherein the outer side wall extends around the inner side wall and is opposite to the inner side wall, the outer side wall and inner side wall being interconnected by an annular top wall, the annular top wall interconnecting the outer side wall to the inner side wall, wherein the combination of the raised annular inner side wall, the raised outer side wall and the annular top wall define a channel; a brim lock in the annular outer side wall for fastening the lid to the container; and a plurality of dimples recessed along the annular outer side wall; wherein the plurality of dimples project away from the channel and are configured to project beyond an outer surface of the annular outer side wall when the lid is secured onto the container.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
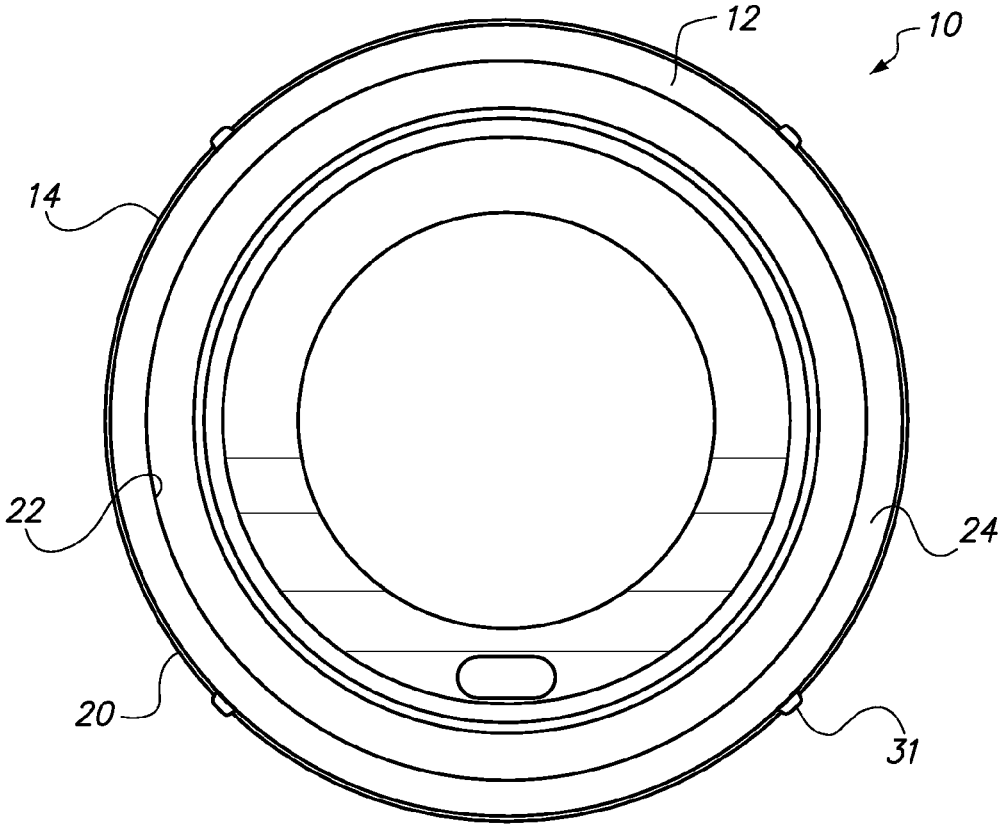
FIG. 1 is top view of a lid illustrating the activated dimples in a raised pop out position.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

It is contemplated that the teaching of the description set forth below is applicable to all types of packaging, including but not limited to, disposable beverage cup containers made from styrofoam, compostable plastic or polymer material, thermoplastic, paper for coffee, tea, soda or other suitable material, as is readily appreciated by one skilled in the art. The present disclosure is therefore not intended to be limited to any particular container apparatus or configuration described in the exemplary embodiments of the present disclosure. It should be appreciated that the present invention may also be applicable to other types of containers, including but not limited to non-disposable containers, such as, for example, a vacuum sealed travel coffee cup, and food storage containers.

Referring now to FIGS. 1-9, the embodiments of the invention pertain to a lid, designated as 10. The lid 10 can be composed of recyclable material, such as PET, RPET, polypropylene, polystyrene, polyethylene, high impact polystyrene or other suitable material. The preferred material of the lid is a flexible and deformable plastic material. The lid 10 includes a container closure 12. The container closure 12 is preferably a disk shaped member made from a moldable or stamped material and includes a circumferential rim 14 extending about a periphery of the container closure 12. The circumferential rim 14 of the periphery is for attachment to a brim 40 of a container 42 and to have a sealing engagement therewith.

The circumferential rim 14 includes a raised annular outer side wall 20, a raised annular inner side wall 22 and an annular top wall 24, which interconnects the raised annular outer side wall and the raised annular inner side wall. The raised annular outer side wall 20, the raised annular inner side wall 22 and the annular top wall 24 define a channel 28 for mating with the brim 40 of the container 42. The outer side wall 20 is disposed opposite to the inner wall 22 at a distance from the inner wall 22 and is contiguous to the top wall 24. The annular outer side wall 20 extends around the annular inner wall 22. The annular outer side wall 20 is generally parallel to and opposite the annular inner side wall 22. The annular side walls 20 and 22 are interconnected by the annular top wall 24, which is generally perpendicular to the annular side walls 20 and 22. The raised annular outer side wall 20, the annular top wall 24 and the annular inner side wall 22 extend around the periphery of the lid 10 and form a channel 28 therebetween. The channel 28 is sized to fit the rim 40 of the container 42.

The annular inner side wall 22 includes annular rib elements 60 and 62. Rib elements 60, 62 form a channel 64 therebetween. The annular rib elements 60 and 62, each has generally convex profile relative to an inner surface of an inside wall of the container 42 and provides a sealing surface and leakage prevention. The rib elements 60 and 62 of the annular inner wall 22, provides lid 10 with a primary sealing surface and a secondary sealing surface, which is an advantageous redundancy. In this aspect, the lid 10 mates and seals with the brim 40 in at least two different locations that are spaced from the top wall 24 of the lid 10.

In an embodiment of the invention, the rib elements 60 and 62 are disposed in continuous rings parallel to one another with the first rib element 60 positioned on the inner side wall in a region proximate to the top wall 24 relative to the second rib element 62, which is positioned below the first rib element 60, for providing a sealing surface and leakage prevention. Each of the first and second annular ribs 60, 62 includes a generally convex profile relative to an inner surface of an inside wall of the container 42, and forms annular rib channel 64 therebetween. The rib channel 64 is intermediate to the first and second annular ribs 60, 62 and positioned at a bottom of the first annular rib 60 and a top of the second annular rib 62.

In an embodiment of the invention, a plurality of inverted dimples 30 is positioned along the annular outer side wall 20 and project inwardly from the outer surface of the annular outer side wall 20. The inverted dimples 30 are positioned along the outer side wall 20 such that prior to engagement of the lid 10 with the brim 40 of the container 42, a crown 32 of the inverted dimples 30 are recessed within the channel 28 of the lid 10. Inverted dimples 30 remain in that position until the lid 10 is placed over the rim 40 of the container 42. When the lid 10 is placed over the rim 40 of the container 42, the crown 32 of the inverted dimples 30 are in communication with the brim or rim 40 of the container 42. The inverted dimples 30 thus reverse direction and project upwards in a raised position so that the raised dimples 31 project beyond the outer surface of the annular outer side wall 20 so as to be perceived by visual or tactile means.

The crown 32 of the inverted dimples 30 extend below the outer surface of the annular outer side wall 20 and is positioned within the channel 28. When lid 10, is placed over the rim 40 of the container 42 for seating the lid 10 to the rim 40, the crown 32 of the inverted dimples 30 contact the rim 40 of the container 42. Applying pressure onto the lid 10 will cause the crown 32 of the inverted dimples 30 to reverse direction and pop out to project outwards beyond the outer surface of the outer side wall 20 of the lid 10 thereby providing both tactile and visual confirmation that the lid 10 is firmly and appropriately seated onto the rim 40 of the container 42

In one embodiment of the invention, equally spaced inverted dimples 30 are positioned in each quadrant of the lid 10. The crown 32 of the inverted dimples 30 reverses direction and project outwards from the outer side wall 20 when the lid 10 is seated firmly to the brim 40 of the container 42. The crown 32 of the raised dimples 31 project outwards beyond the surface of the outer side wall 20 such that the crown 32 of the raised dimples 31 may be observed visually from a side or top view. The sight of the raised or projecting dimples 31 confirms that the lid 10 is properly seated or fitted onto the rim or brim 40 of a container 42. The crown 32 of the raised dimples 31 may also be perceived by tactile means by tracing a finger along the surface of the outer side wall 20. The raised dimples 31 are generally semi-elliptical in shape, but may also be semi-spherical, triangular, rectangular, square or any other suitable geometric shape or size.

In another embodiment, a recessed dimple 33 is mounted to a support base 50. The recessed dimple 33 is raised beyond an apex 54 of the support base 50 when the lid 10 is firmly seated to the rim 40 of a container 42. In another embodiment, the support base includes a plurality of panels 52 which form a support for the recessed dimple 33.

In yet a further embodiment, an inverted dimple 30 is mounted to a support base 50. The inverted dimple 30 reverses direction and projects outwards to assume a raised position 31 beyond the apex 54 of the support base 50 when the lid 10 is seated to the rim 40 of the container 42.

Thus, in this manner, when the lid 10 is affixed to the rim 40, visual inspection of the lid 10 with respect to the container 42 is readily apparent and the structural integrity of the fastened lid 10 in conjunction with the container 42 can be assessed. It is noted that any number, size and configuration of the dimples 30 may be included so long as the visual inspection of the lid 10 with respect to the rim 40 of the container 42 is readily apparent and the structural integrity of the lid 10 is maintained. In one embodiment, dimples 30 are equally spaced in each quadrant of the lid 10. The precise spacing and number of dimples 30 may vary. Various configurations of the lid 10 and dimples 30 are possible and within the scope of the invention. It will be appreciated by those reasonably skilled in the art that the dimples 30 and lid 10 may include various diameters and heights based on the type of lid 10 and container.

FIG. 1 is top view of a lid illustrating the activated dimples in a raised popped out position. As shown in FIG. 1 of a lid 10 and lid closure 12, the activated dimples 31 are in a raised pop out position when firmly seated to the rim 40 of a container (not shown). Components of the lid closure 12 are indicated by reference numerals, the annular outer side wall 20 extends around the annular inner side wall 22 and is disposed at a distance from the annular inner side wall. Annular walls 20 and 22 are interconnected by annular top wall 24. The dimples 31 are positioned along the outer side wall 20. As shown in FIG. 1, the raised of activated dimple 31 is in each quadrant of the lid 10. The raised dimples 31 may be perceived visually from a top view or by tracing a finger along the outer surface of the annular outer side wall 20.

Figure 2:
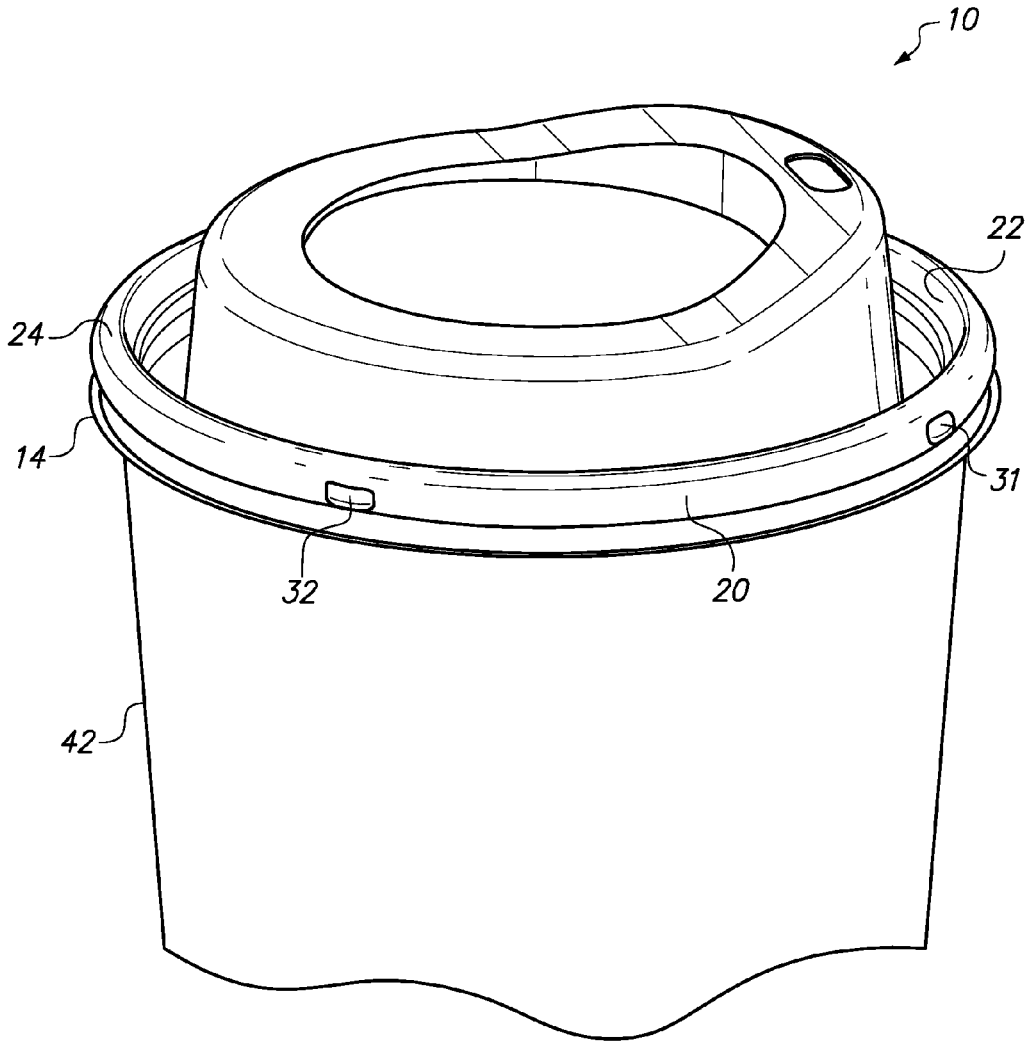
FIG. 2 is a side perspective view of the lid with the dimples activated and projecting outwards in a raised pop out position.

FIG. 2 is a side perspective view of the lid with the dimples activated and projecting outwards in a raised pop out position. Referring now to FIG. 2 there is shown a side perspective view of the lid 10 firmly seated to the rim of the container 42 with the dimples 31 activated and projecting upwards and the crowns 32 in a raised pop up position. The raised dimples 31 may be perceived visually by viewing the lid from a top or side view or by tracing a finger along the surface of the annular outer side wall 20.

Figure 3:
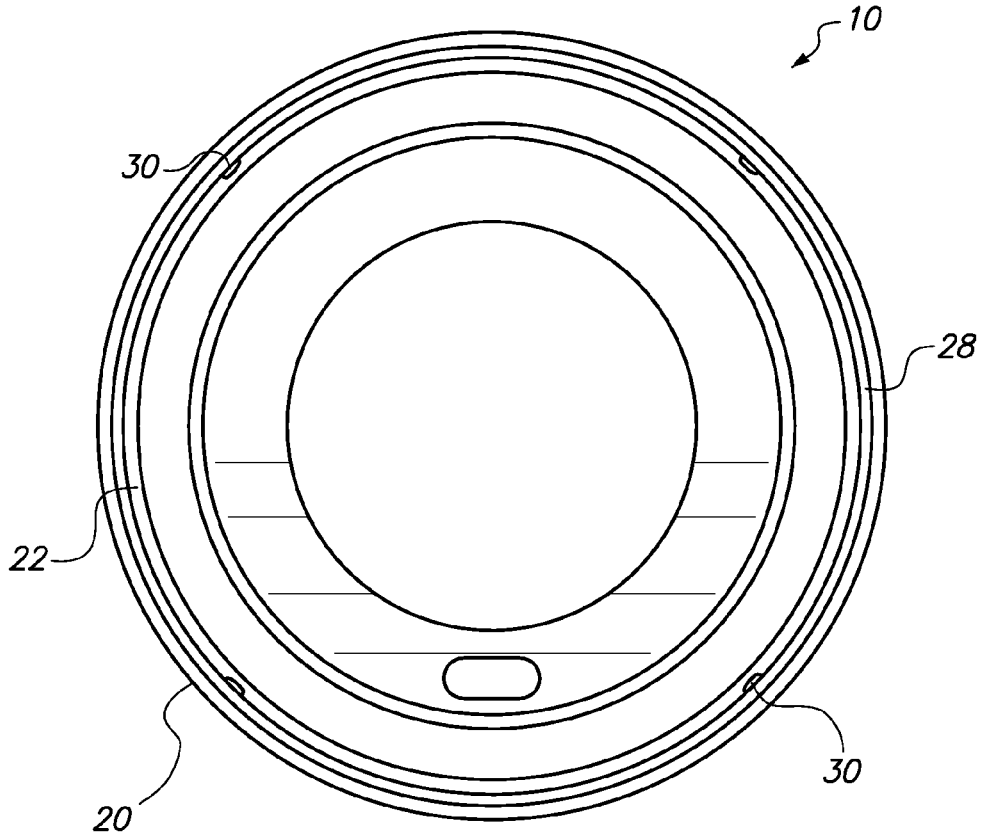
FIG. 3 is a bottom view of the lid with the dimples in a de-activated and inverted position.

FIG. 3 is a bottom view of the lid 10 with the inverted dimples 30 in a de-activated position. The annular outer and inner side walls, 20, 22, in conjunction with the top annular wall 24, form the channel 28 therein. As shown, the inverted dimples 30, project into the channel 28 away from the outer surface of the annular outer side wall 20.

Figure 4:
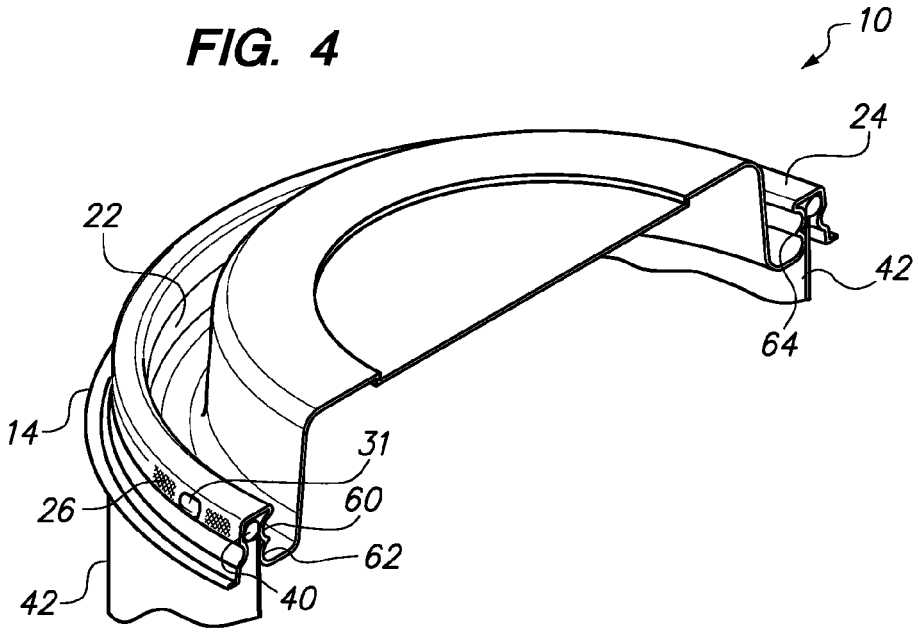
FIG. 4 is a cross sectional view of an embodiment of the lid with pressure point markings on either side of the activated dimples in a raised pop out position.

FIG. 4 is a cross sectional view of an embodiment of the lid with pressure point markings on either side of the activated dimples in a raised pop out position. FIG. 4 is a partial view of another embodiment of the lid 10 with pressure points 26 located generally on either side of the activated dimples 31 in a raised pop out position. The pressure points 26 are shown as etchings, however, the pressure points 26 may be designated by any visually or otherwise tangible and perceptible means. As shown in FIG. 4, the annular inner side wall 22 includes annular rib elements 60, 62 forming a channel 64 therebetween. Annular rib elements 60 and 62, each comprise a generally convex profile relative to an inner surface of an inside wall of the container 42 and provide a sealing surface and leakage prevention.

Figure 5:
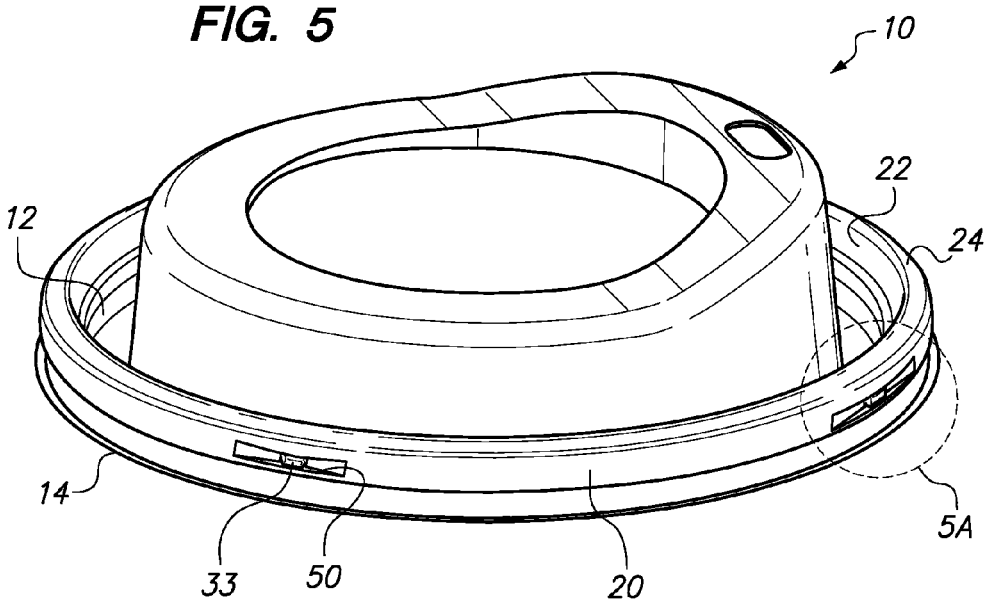
FIG. 5 is a rear perspective view of an alternative embodiment of the lid with recessed dimples mounted on support bases.

FIG. 5 is a rear perspective view of an alternative embodiment of the lid with recessed dimples mounted on support bases. Now referring to FIG. 5, an alternative embodiment of the lid 10 of the invention is shown. In this embodiment, recessed dimples 33 are individually mounted on a plurality of support bases 50 positioned along the outer side wall 20.

Figure 5A:
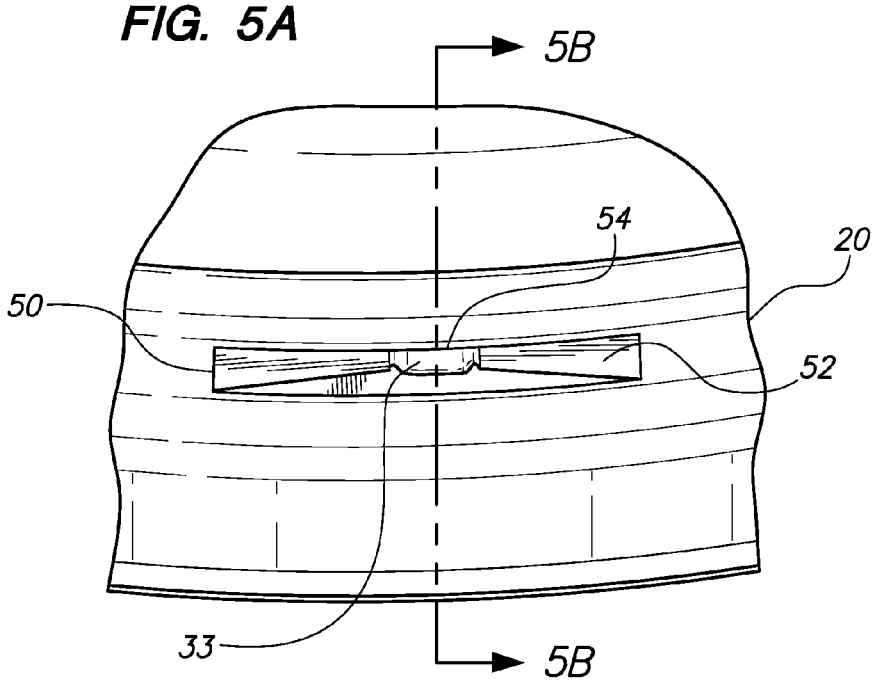
FIG. 5A is a partial view of section 5B of FIG. 5 of a dimple in a recessed position and mounted on a support base.

FIG. 5A is a partial view of section 5B of FIG. 5 of a dimple in a recessed position and mounted on a support base. Now referring to FIG. 5A, there is shown a close-up view of a recessed dimple 33 mounted on top of a support base 50. The support base 50 is shown to include a plurality of panels 52. The panels 52 project upwards from the annular outer side wall 20 to form a support structure in which the recessed dimple 33 is mounted.

Figure 5B:
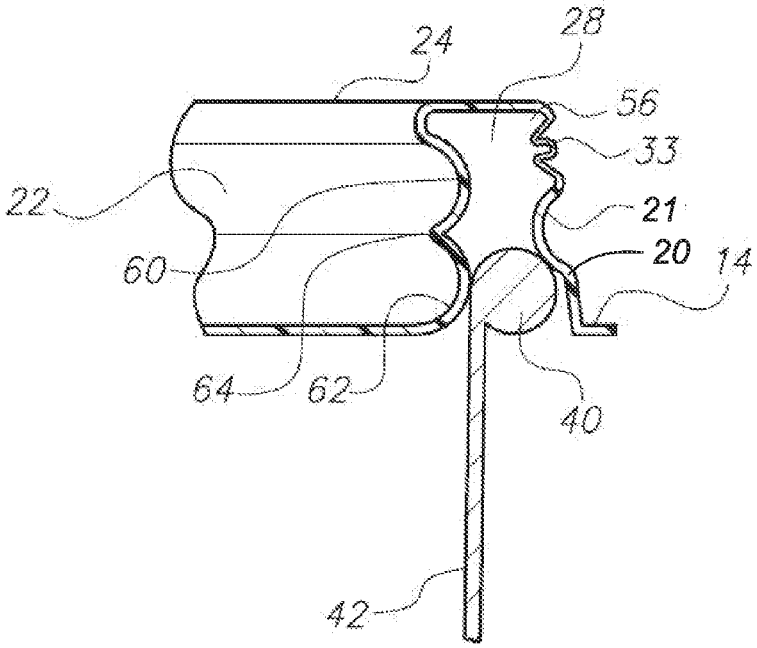
FIG. 5B is a cross sectional view taken along line 5B-5B of FIG. 5A and illustrates the lid being placed over the brim of a container, but not firmly seated thereon.

FIG. 5B is cross sectional view of the lid 10 of an embodiment of the invention taken along line 5B-5B of FIG. 5A illustrating a recessed dimple 33 mounted on a support base 50. As illustrated, the panels 52 of the support base 50 form a cavity 56 for receiving the recessed dimple 33. The lid 10 is shown in contact with the rim 40 of the container 42, but not firmly seated thereto as indicated by the position of the recessed dimple 33. Annular inner side wall 22 includes annular rib elements 60, 62 forming a channel 64 therebetween. Annular rib elements 60 and 62, each comprise a generally convex profile relative to an inner surface of an inside wall of the container 42 and provide a sealing surface and leakage prevention. An annular brim lock rib 21 of the annular outer side wall 20 has a convex profile facing toward the annular rib elements 60, 62. The annular brim lock 21 snaps over the brim 40 of the container 42 to fasten the lid 10 to the container 42. In the alternative, a series of indentation around the annular outer side wall 20 can be the brim lock of the lid 10.

As can be seen in FIG. 5B, the annular rib elements 60, 62 of the annular inner side wall 22 form a primary and secondary sealing surface to secure the brim 40 to the lid 10. More specifically, the first and second annular ribs 60, 62 each include a generally convex profile relative to an inner surface of an inside wall of the container 42, and form annular rib channel 64 therebetween. The rib channel 64 is intermediate to the first and second annular ribs 60, 62 and positioned at a bottom of the first annular rib 60 and a top of the second annular rib 62.

Figure 5C:
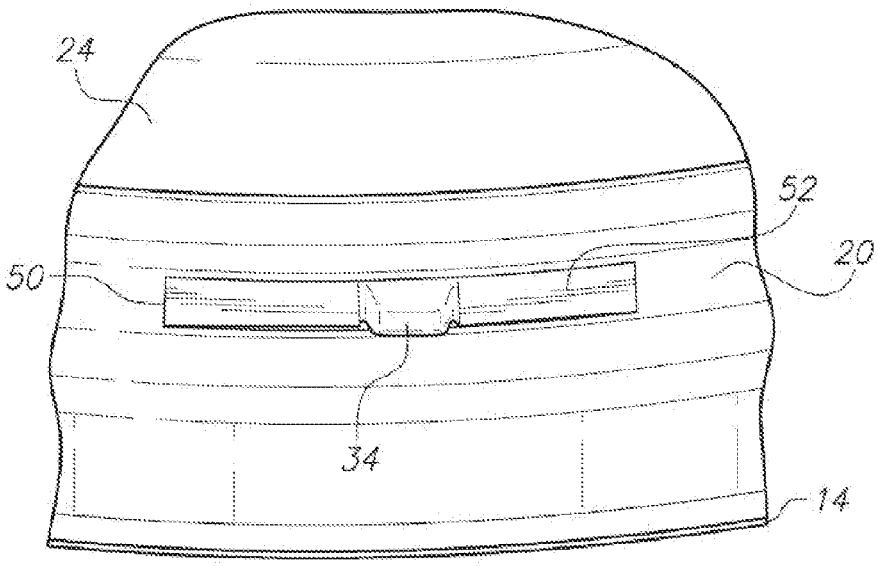
FIG. 5C is a partial view of a dimple mounted on a support base in an elevated position.

FIG. 5C is a partial view of a dimple mounted on a support base in an elevated position. As shown in FIG. 5C, the lid 10 is firmly and securely seated onto the rim 40 (not shown) of the container 42 (not shown). The raised position of the elevated dimple 34 mounted to the support base 50 confirms that the lid 10 is appropriately secured onto the container 42

Figure 6:
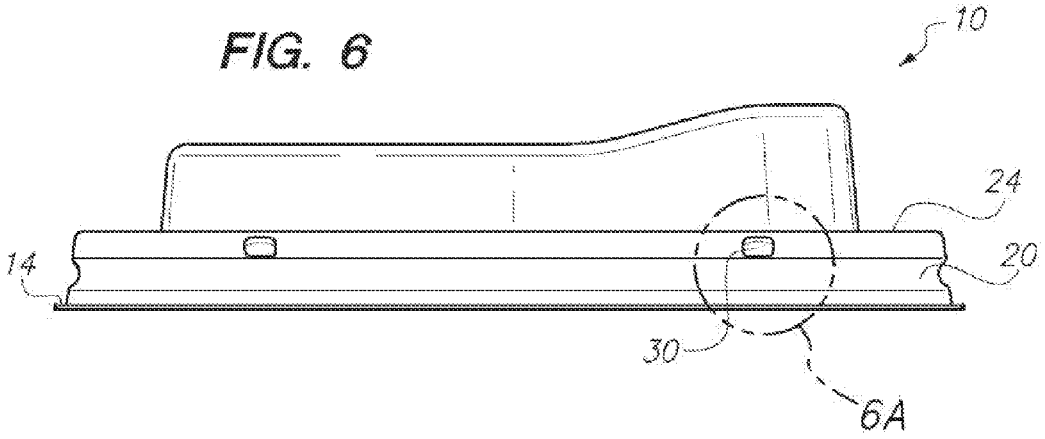
FIG. 6 is a side view of the lid with the de-activated dimples in an inverted position.

FIG. 6 is a side view of the lid with the de-activated dimples in an inverted position. As shown in FIG. 6, the lid 10 with the de-activated dimples 30 are in an inverted position. The dimples are not visually perceptible when the lid is viewed from a side perspective.

Figure 6A:
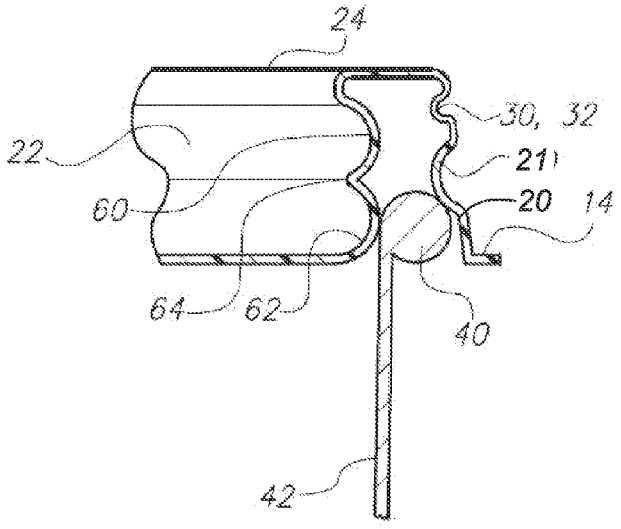
FIG. 6A is a close-up sectional view of 6A of FIG. 6 illustrating the lid making contact with the brim of a container.

FIG. 6A is a close-up sectional view of 6A of FIG. 6 illustrating the lid making contact with the brim of a container. As shown in FIG. 6A, an inverted dimple 30 of the lid 10 makes contact with the rim 40 of a container. As illustrated by the inverted dimple 30, the lid 10 is not firmly seated on the rim 40 of the container. Annular inner side wall 22 includes annular rib elements 60, 62 forming a channel 64 therebetween. Annular rib elements 60 and 62, each comprise a generally convex profile relative to an inner surface of an inside wall of the container 42 and provide a sealing surface and leakage prevention. The first and second annular ribs 60, 62 form annular rib channel 64 therebetween. An annular brim lock rib 21 of the annular outer side wall 20 has a convex profile facing toward the annular rib elements 60, 62. The annular brim lock 21 snaps over the brim 40 of the container 42 to fasten the lid 10 to the container 42. In the alternative, a series of indentation around the annular outer side wall 20 can be the brim lock of the lid 10.

Figure 7:
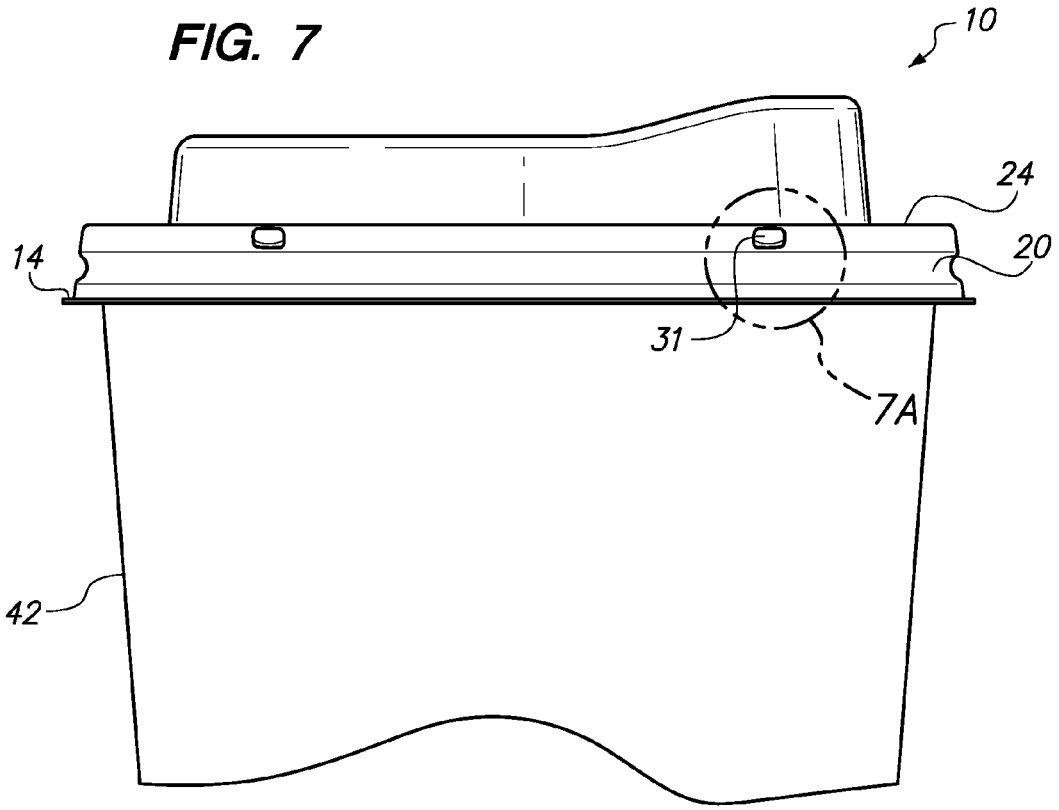
FIG. 7 is a side view of the lid with the activated dimples in a pop out position.

FIG. 7 is a side view of the lid with the activated dimples in a pop out position. Referring to FIG. 7, there is shown a side perspective view of the lid 10 with the activated dimples 31 in a raised pop up position. As is shown, the raised dimples 31 are visually perceptible. The raised or non-inverted dimples 31 may also be perceived by tracing the surface of the outer side wall 20.

Figure 7A:
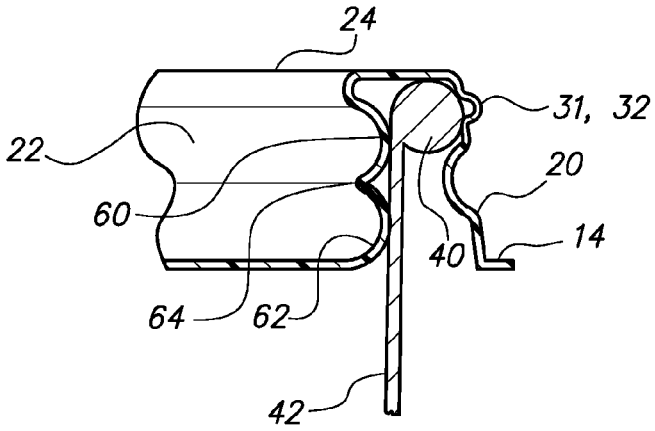
FIG. 7A is a close up sectional view of 7A of FIG. 7 illustrating an activated dimple in a raised pop out position when the lid is firmly seated and fastened over the brim of a container.

FIG. 7A is a close up sectional view of 7A of FIG. 7 illustrating an activated dimple in a raised pop out position when the lid is firmly seated and fastened over the brim of a container. Now referring to FIG. 7A there is shown a close up sectional view of 7A of FIG. 7 illustrating an activated dimple 31 in a raised pop up position when the lid 10 is firmly seated over the rim 40 of a container. The crown 32 of the dimple 31 is no longer in communication with the rim 40 and projects outward beyond the surface of the annular outer side wall 20 when the lid 10 is firmly seated on the rim 40 of the container. Annular inner side wall 22 includes annular rib elements 60, 62 forming a channel 64 therebetween. Annular rib elements 60 and 62, each comprise a generally convex profile relative to an inner surface of an inside wall of the container 42 and provide a sealing surface and leakage prevention. The first and second annular ribs 60, 62 each include a generally convex profile relative to an inner surface of an inside wall of the container 42, and form annular rib channel 64 therebetween. The rib channel 64 is intermediate to the first and second annular ribs 60, 62 and positioned at a bottom of the first annular rib 60 and a top of the second annular rib 62.

Figure 8:
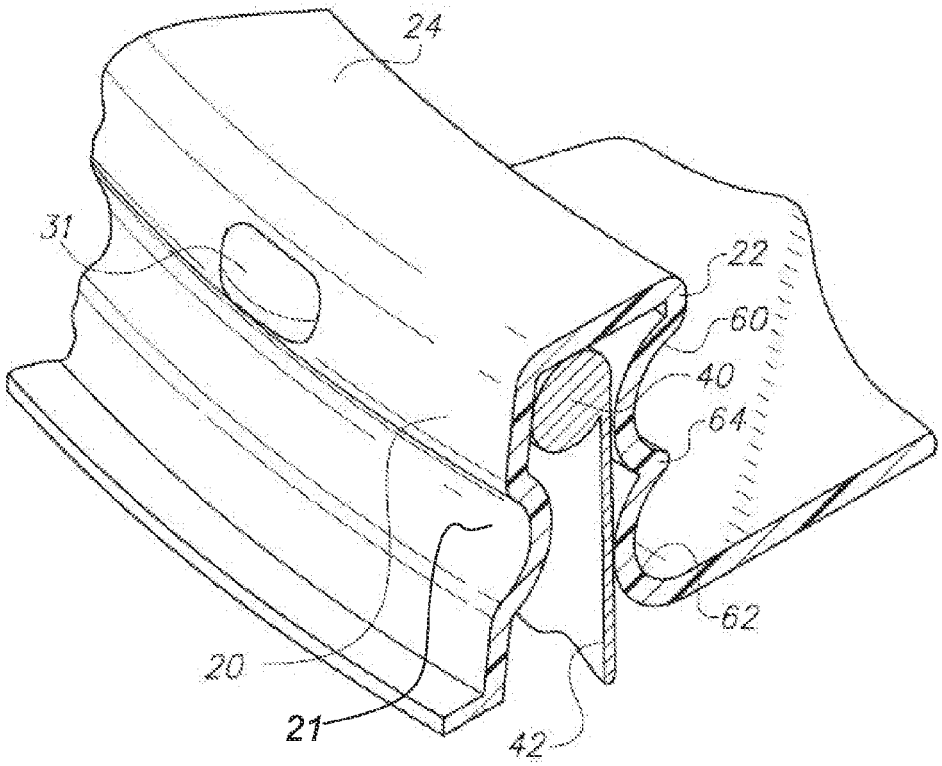
FIG. 8 shows a cross sectional view of circumferential rim of the lid according to embodiment of the invention, including the outer side wall, top wall and inner side wall, in use with the brim of a container with an activated dimple in a raised pop out position.

FIG. 8 shows a cross sectional view of circumferential rim of the lid according to embodiment of the invention, including the outer side wall, top wall and inner side wall, in use with the brim of a container with an activated dimple in a raised pop out position. As shown in FIG. 8, the circumferential rim 14 of the lid 10 in embodiments of the invention, including the outer side wall 20, top wall 24 and inner side wall 22, in use with the brim 40 of a container 42. The outer side wall 20 includes raised dimples 31 projecting outward from the surface of the outer side wall 20 to indicate that the lid 10 is firmly seated to the brim 40 of the container 42. The annular brim lock 21 is between the dimples 31 and the top wall 24.

Figure 9:
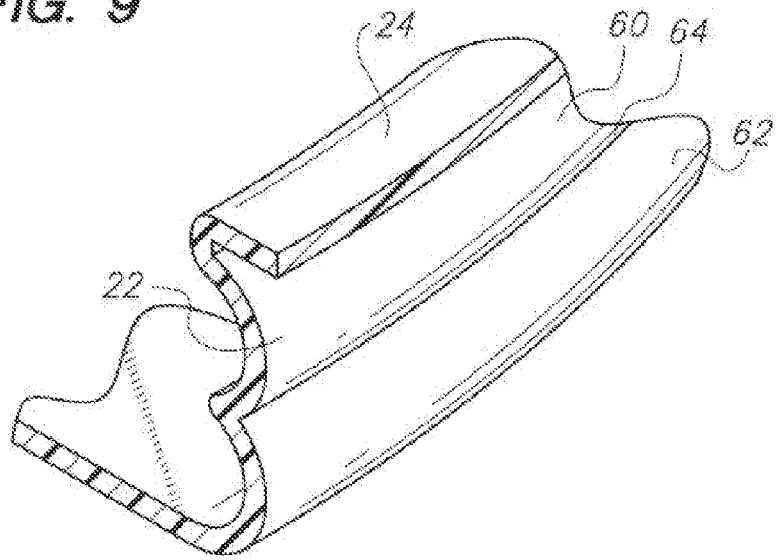
FIG. 9 is a partial sectional view of the inner side wall of the lid according to embodiment of the invention including parallel inner ribs along the inner side wall.

FIG. 9 is a partial sectional view of the inner side wall of the lid according to embodiment of the invention including parallel inner ribs along the inner side wall. As shown in FIG. 9, the inner side wall 22 of the lid 10 in embodiments of the invention has annular rib elements 60, 62 forming a channel 64 therebetween. As shown, the first and second annular ribs 60, 62 form annular rib channel 64 therebetween. The rib channel 64 is intermediate to the first and second annular ribs 60, 62 and positioned at a bottom of the first annular rib 60 and a top of the second annular rib 62.

Thus, while there have shown and described and pointed out fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A lid for a container comprising:

a closure having a disk shape and a circumferential rim extending about a periphery of the closure;

the circumferential rim further comprising an annular inner side wall, an annular outer side wall, wherein the outer side wall extends around the inner side wall and is opposite to the inner side wall, the outer side wall and inner side wall being interconnected by an annular top wall, the annular top wall interconnecting the outer side wall to the inner side wall, wherein the combination of the annular inner side wall, the annular outer side wall and the annular top wall define a channel; and a brim lock in the annular outer side wall for fastening the lid to the container;

a plurality of dimples inverted along the annular outer side wall, wherein the plurality of dimples of the annular outer side wall project into the channel from the outer surface of the annular outer side wall and configured to be non-inverted dimples when the lid is secured onto the container.

2. The lid according to claim 1, wherein the inner side wall comprises at least one annular rib including a generally convex profile relative to an inner surface of an inside wall of the container, the at least one annular rib disposed along the annular inner side wall for providing a sealing surface and leakage prevention.

3. The lid according to claim 2, wherein the annular inner side wall includes first and second annular ribs disposed in continuous rings parallel to one another for providing a sealing surface and leakage prevention; wherein the first annular rib is positioned proximate to the top wall and on a top portion of the inner side wall, relative to the second annular rib which is positioned below the first annular rib; the first and second annular ribs each include a generally convex profile relative to an inner surface of an inside wall of the container, and form an annular rib channel therebetween, the rib channel of the inner side wall is intermediate to the first and second annular ribs and positioned at a bottom of the first annular rib and a top of the second annular rib.

4. The lid according to claim 3, wherein the rib channel is positioned for retaining liquid that seeps beyond the second annular rib prior to contacting the first annular rib; the first and second annular ribs of the inner side wall thereby form a secondary and primary sealing surface respectively for preventing leakage, with the rib channel therebetween forming a reservoir to retain liquid that seeps beyond the second annular rib prior to contacting the first annular rib.

5. The lid according to claim 1, wherein the inverted dimples project inwards and are within the outer surface of the annular outer side wall.

6. The lid according to claim 1, wherein the dimples project outwards beyond the outer surface of the annular outer side wall to assume a raised position pursuant to the application of a force on the plurality of inverted dimples when the lid is seated to the rim of the container.

7. The lid according to claim 1, wherein the raised dimples project beyond the outer surface of the annular outer side wall and can be perceived tangibly.

8. The lid according to claim 1, wherein the lid is fabricated using a mold configured for female tooling.

9. The lid according to claim 1, wherein the annular outer side wall includes one of the plurality of dimples positioned in each quadrant of the lid.

10. A lid for a container comprising:

a closure having a disk shape and a circumferential rim extending about a periphery of the closure;

the circumferential rim further comprising a raised annular inner side wall, a raised annular outer side wall, wherein the outer side wall extends around the inner side wall and is opposite to the inner side wall, the outer side wall and inner side wall being interconnected by an annular top wall, the annular top wall interconnecting the outer side wall to the inner side wall, wherein the combination of the raised annular inner side wall, the raised outer side wall and the annular top wall define a channel;

a brim lock in the annular outer side wall for fastening the lid to the container; and a plurality of dimples recessed along the annular outer side wall;

wherein the plurality of dimples project away from the channel and are configured to project beyond an outer surface of the annular outer side wall when the lid is secured onto the container.

11. The lid according to claim 9, wherein the inner side wall comprises at least one annular rib including a generally convex profile relative to an inner surface of an inside wall of the container, the at least one annular rib disposed along the raised annular inner side wall for providing a sealing surface and leakage prevention.

12. The lid according to claim 10, wherein the annular inner side wall includes first and second annular ribs disposed in continuous rings parallel to one another for providing a sealing surface and leakage prevention; wherein the first annular rib is positioned proximate to the top wall and on a top portion of the inner side wall, relative to the second annular rib which is positioned below the first annular rib; each of the first and second annular ribs includes a generally convex profile relative to an inner surface of an inside wall of the container, and form an annular rib channel therebetween, the rib channel of the inner side wall is intermediate to the first and second annular ribs and positioned at a bottom of the first annular rib and a top of the second annular rib.

13. The lid according to claim 11, wherein the rib channel is positioned for retaining liquid that seeps beyond the second annular rib prior to contacting the first annular rib;

the first and second annular ribs of the inner side wall thereby form a secondary and primary sealing surface respectively for preventing leakage, with the rib channel therebetween forming a reservoir to retain liquid that seeps beyond the second annular rib prior to contacting the first annular rib.

14. The lid according to claim 9, wherein the plurality of dimples project outwards and are recessed within the outer surface of the annular outer side wall.

15. The lid according to claim 9, wherein the plurality of dimples project outwards beyond the outer surface of the annular outer side wall to assume a raised position pursuant to the application of a force on the plurality of recessed dimples when the lid is seated to the rim of the container.

16. The lid according to claim 9, wherein the plurality of dimples project outwards beyond the annular outer side wall when the lid is secured onto the rim of the container.

17. The lid according to claim 15, wherein the raised dimples project beyond the outer surface of the annular outer side wall and can be perceived tangibly.

18. The lid according to claim 9, wherein the lid is fabricated using a mold configured for female tooling.

19. The lid according to claim 9, wherein the annular outer side wall includes one of the plurality of dimples positioned in each quadrant of the lid.

* * * * *